US008373553B2

(12) United States Patent
Bell

(10) Patent No.: US 8,373,553 B2
(45) Date of Patent: Feb. 12, 2013

(54) SYSTEM AND METHOD FOR AUTOMATIC ENROLLMENT OF TWO-WAY WIRELESS SENSORS IN A SECURITY SYSTEM

(75) Inventor: Dwayne A. Bell, Zephyr (CA)

(73) Assignee: Tyco Safety Products Canada Ltd, Concord, Ontario (CA)

( * ) Notice: Subject to any disclaimer, the term of this patent is extended or adjusted under 35 U.S.C. 154(b) by 658 days.

(21) Appl. No.: 12/606,311

(22) Filed: Oct. 27, 2009

(65) Prior Publication Data

US 2011/0095882 A1 Apr. 28, 2011

(51) Int. Cl.
*G08B 26/00* (2006.01)

(52) U.S. Cl. ..... 340/505; 340/988; 340/7.51

(58) Field of Classification Search ..... 340/505, 340/6.1, 7.2, 7.21, 10.4, 10.42, 905, 7.27, 340/7.25, 501, 988–990, 7.51, 7.55
See application file for complete search history.

(56) References Cited

U.S. PATENT DOCUMENTS

| | | | | |
|---|---|---|---|---|
| 4,772,876 | A | 9/1988 | Laud | |
| 4,855,713 | A * | 8/1989 | Brunius | 340/506 |
| 4,951,029 | A | 8/1990 | Severson | |
| 5,291,193 | A | 3/1994 | Isobe et al. | |
| 5,625,338 | A | 4/1997 | Pildner et al. | |
| 5,781,143 | A | 7/1998 | Rossin | |
| 5,907,279 | A * | 5/1999 | Bruins et al. | 340/506 |
| 6,169,903 | B1 * | 1/2001 | Dorenbosch et al. | 455/458 |
| 6,450,411 | B1 * | 9/2002 | Rash et al. | 236/44 A |
| 6,624,750 | B1 | 9/2003 | Marman et al. | |
| 6,686,838 | B1 | 2/2004 | Rezvani et al. | |
| 6,693,529 | B2 | 2/2004 | Suzuki et al. | |
| 6,721,283 | B1 | 4/2004 | Marino et al. | |
| 6,756,895 | B2 | 6/2004 | Study et al. | |
| 6,943,681 | B2 | 9/2005 | Rezvani et al. | |
| 7,039,391 | B2 | 5/2006 | Rezvani et al. | |
| 7,746,222 | B2 * | 6/2010 | Kogan et al. | 340/506 |
| 2002/0049654 | A1 | 4/2002 | Thomas et al. | |
| 2003/0016128 | A1 | 1/2003 | Lutz et al. | |
| 2004/0041703 | A1 | 3/2004 | Bergman et al. | |
| 2004/0103312 | A1 | 5/2004 | Messerges et al. | |
| 2004/0160306 | A1 | 8/2004 | Stilp | |

(Continued)

FOREIGN PATENT DOCUMENTS

| | | |
|---|---|---|
| WO | WO 01/47232 A2 | 6/2001 |
| WO | WO 01/47232 A3 | 6/2001 |

OTHER PUBLICATIONS

International Searching Authority, International Search Report and Written Opinion dated Feb. 1, 2011 for International Application No. PCT/CA2010/001694, (con'd).
International Filing Date Oct. 25, 2010 (8 pages).

*Primary Examiner* — Daniel Previl
(74) *Attorney, Agent, or Firm* — Kacvinsky Daisak PLLC

(57) ABSTRACT

A system and method are disclosed for enrolling two-way wireless security system devices (alarms, detectors, lights) in a security system. A controller is provided and is capable of exchanging wireless signals with the two-way wireless devices. The system has an enroll mode where the two-way wireless devices transmit enroll signals to the controller. The enroll signals contain an identifier associated with each device. An installer uses a keypad or other interface device to confirm enrollment of each of the devices. The controller sends an enroll confirmation signal back to the two-way wireless devices confirming that the devices have been enrolled. In response, each of the devices emits an audible or visual enroll confirmation signal to the installer.

25 Claims, 5 Drawing Sheets

U.S. PATENT DOCUMENTS

2006/0274698 A1* 12/2006 Twitchell ..... 370/331
2008/0094204 A1 4/2008 Kogan et al.
2010/0231361 A1 9/2010 Bell
2010/0265068 A1* 10/2010 Brackmann et al. ..... 340/572.1

* cited by examiner

SYSTEM AND METHOD FOR AUTOMATIC ENROLLMENT OF TWO-WAY WIRELESS SENSORS IN A SECURITY SYSTEM

FIELD OF THE INVENTION

Embodiments of the invention relate to the field of wireless security systems employing two-way wireless system devices. More particularly, embodiments of the invention relate to a system and method for automatic system enrollment of two-way wireless security system devices.

DISCUSSION OF RELATED ART

Typical building alarm systems often include a number of sensors positioned throughout a building to alert occupants of fire and non-fire emergencies. These sensors may include smoke detectors, fire alarms, security alarms, emergency lighting, strobe lighting, door contacts, motion detectors, and the like. The sensors are usually connected to a system controller that contains specific information regarding each sensor, so that when a signal is received from a sensor, the controller immediately knows what area of the building is affected and what type of condition is occurring (e.g., open window, smoke, fire). In addition, for systems employing two-way wireless sensors in a zoned configuration, the controller must know which sensors are part of that controller's zone so that only the sensors in that zone will be acted upon.

To provide the controller with the necessary sensor information, during system installation it is necessary to "enroll" the sensors with the controller. Enrolling the sensors can require extensive manual input of information identifying each sensor in the system. This technique, aside from being arduous, is subject to errors since the installer often must read the serial number from a plate on the sensor and then must correctly type that serial number into a keypad associated with the controller.

Automated systems for enrolling wireless sensors may be similarly cumbersome in that they often require the individual sensors to be operated in a unique manner (e.g., reducing sensor power to a predetermined level), or they may require the sensors to be passed very close to the controller in order for the controller to read the serial number, or they may require the sensors to be enrolled in a specific predetermined sequence.

There is a need for an improved system for efficiently enrolling two-way wireless sensors in security systems. The system should minimize the total amount of manual action required, should eliminate errors associated with current manual input techniques, and should provide a simplified automated enrollment process for systems employing a plurality of two-way wireless sensors.

SUMMARY OF THE INVENTION

The disclosed system and method increase the efficiency of enrolling wireless security system devices by reducing the amount of manual intervention required with prior systems. Specifically, the disclosed system and method automatically enrolls two-way wireless (RF) devices, provides serial numbers and/or other information relating to the devices, and informs the system of the enrollment status of the devices.

A method is disclosed for enrolling two-way wireless devices in a security system, comprising: receiving, at a controller, a wireless signal from each of a plurality of two-way wireless devices, the wireless signal from each two-way wireless device containing a unique identifier associated with that two-way wireless device; storing the unique identifiers in memory associated with the controller; and transmitting, from the controller, a wireless signal to each of the plurality of two-way wireless devices, the signal confirming enrollment of the plurality of two-way wireless devices.

A system is disclosed for enrolling wireless devices in a security system, comprising a controller having a processor, and a plurality of two-way wireless devices. The controller may perform the steps comprising: receiving, at a controller, a wireless signal from each of a plurality of two-way wireless devices, the wireless signal from each two-way wireless device containing a unique identifier associated with that two-way wireless device; storing the unique identifiers in memory associated with the controller; and transmitting, from the controller, a wireless signal to each of the plurality of two-way wireless devices, the signal confirming enrollment of the plurality of two-way wireless devices.

BRIEF DESCRIPTION OF THE DRAWINGS

The details of the invention, both as to its structure and operation, may be obtained by a review of the accompanying drawings, in which like reference numerals refer to like parts, and in which.

DESCRIPTION OF EMBODIMENTS

Figure 1:
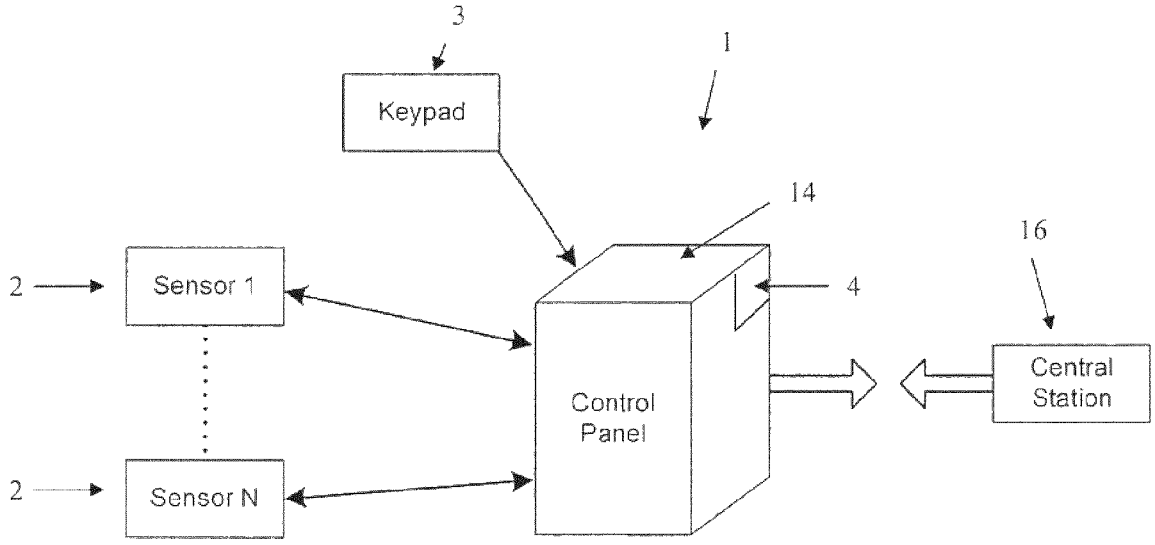
FIG. 1 is a schematic diagram of the disclosed system.

The present invention will now be described more fully hereinafter with reference to the accompanying drawings, in which preferred embodiments of the invention are shown. It will be appreciated, however, that the invention may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Referring to FIG. 1, a security system 1 for a commercial or residential building may include a plurality of two-way wireless devices 2 positioned throughout the building or a portion of the building, and a system controller 4 configured to receive signals from the devices 2. A non-limiting exemplary list of such two-way wireless devices 2 includes, heat, smoke, fire and toxic gas detectors, fire alarms, security alarms, emergency lighting, strobe lighting, door contact detectors, motion detectors, and the like. At least one of the devices may be a hard wired or two-way wireless key pad 3. The two-way wireless devices 2 may be capable of sending wireless signals to the controller 4 indicative of one or more alarm or status conditions. Communications between the devices 2, keypad 3 and the controller 4 may be via one or more wireless (e.g., RF, infrared, laser, ultrasound) communications links.

The two-way wireless devices 2 may be battery powered, and may be configured to transmit a signal representative of the status of the devices (e.g., alarm condition or other status). The devices 2 may also be configured to transmit an identification signal that enables the system controller 4 to recognize the particular device, or the type of device (e.g., door contact, motion detector) being enrolled. In one embodiment, the identification signal represents a unique serial number or other unique identifier associated with the device 2. The identification signal may also include information regarding wireless signal strength of the device, and/or the type of device being enrolled, or any other pertinent information regarding the device.

Figure 2:
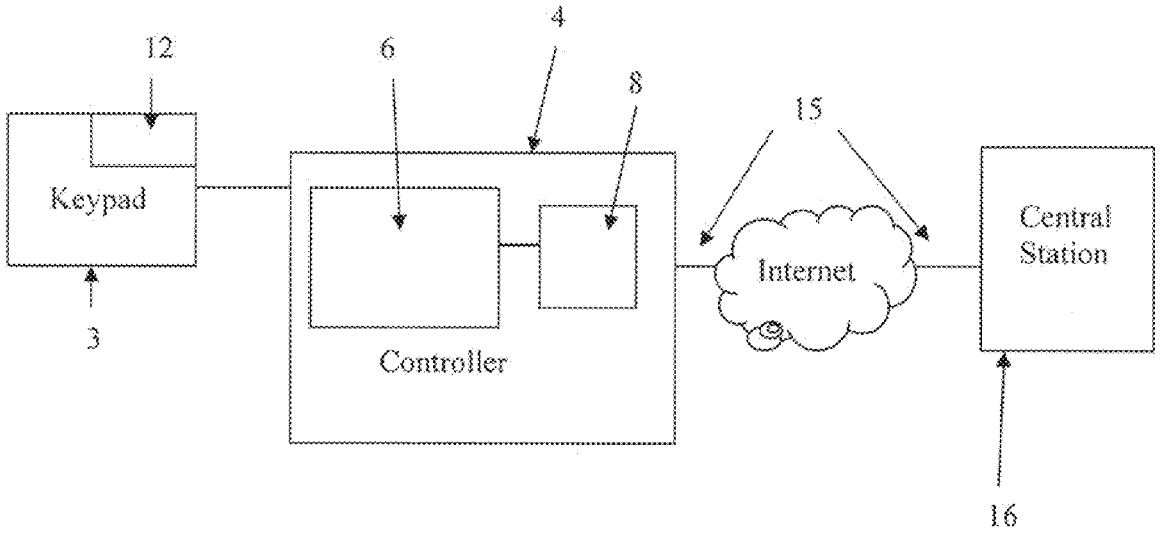
FIG. 2 is a schematic diagram of an exemplary controller of the system of FIG. 1.

Referring to FIG. 2, the controller 4 may have a processor 6 and local memory 8 (e.g., a buffer) for storing a variety of information relating to the system 1 and the two-way wireless devices 2. The controller 4 may have separate zones for different devices 4 being monitored. In one embodiment, a first zone is used for a front entry door contact, a second zone is used for a patio door contact, a third zone is used for a motion detector and a fourth zone is used for a smoke detector. Typically, a single wireless zone has a single detection device, such that that zone has a specific functionality (e.g., entry/exit door contact, smoke detector, motion detector).

A keypad 3 or other user interface device may be in communication with the processor 6 to enable a user to manipulate the system controller 4. The keypad 3 and/or controller 4 may have a graphical display 12 for communicating system status or other information regarding the controller 4 or one or more of the devices 4 to the user. The keypad 3 may be connected to the system controller 4 via a hard wired bus or a two-way wireless communication so that the keypad 3 can be mounted at a location remote from the controller. This is helpful where it is desired to mount the keypad near the front door of the building being monitored, while the controller 4 is mounted in a remote location such as the basement, closet or service space.

The security system 1 may have local and/or remote two-way wireless alarm outputs. Local alarms may include indoor and/or outdoor bells or sirens and/or lights/strobes, which may be used to signal an evacuation notice or to scare off an intruder. The controller 4 may be housed in a security system panel 14 (see FIG. 1) associated with the monitored building. The controller 4 and panel 14 may be in communication with a central monitoring facility 16 via a wireless or hard wired communication link 15. The communication link 15 may be any of a variety of analog or digital communications forms. Thus, the communications link may be an analog phone line or it may be a digital transmission line. In addition, a portion or all of the communications link may be a hard wired or wireless connection. A non-limiting list of exemplary technologies making up the communication link includes analog or digital phone lines, fiber optic lines, T1 or T2 lines, public/private networks, wireless (Radio Frequency (RF)), cellular and/or satellite connections. In addition, a portion of the communication link 15 may be a public or private network (e.g., the Internet).

The central monitoring facility 16 monitors the status of the security system 1 and initiates appropriate action (e.g., alert building personnel, alert appropriate local authorities) when an alarm condition exists, as indicated by one or more of the two-way wireless, or hardwired devices 2. Typically the central monitoring facility 16 is geographically remote from the building or buildings being monitored, and in practical application the central monitoring facility 16 will often simultaneously monitor a plurality of different buildings.

The controller 4 may have a variety of operating modes, including an enroll mode which is used to enroll the two-way wireless devices 2, by zone, in the security system 1. The controller 4 may also have a monitoring or operating mode for receiving a plurality of signals from the enrolled two-way wireless devices 2 indicative of their status. The signals transmitted from the devices 2 to the controller 4 may inform the controller 4 of the status of the particular device 2, including alarm conditions, low power conditions, power cycling conditions, enrollment requests, and the like.

During installation, a technician may mount the system panel 14 (including controller 4), and two-way wireless devices 2 (including keypad 3) at desired locations throughout the monitored building. In one embodiment, each two-way wireless device 2 is configured to automatically send its identifying information when the device 2 is snapped into its mounting bracket. It will be appreciated that other techniques can also be used to initiate sending of the enroll command, such as manually cycling (e.g., by finger press) of the device's tamper switch. The enroll command may be sent intermittently and/or continuously until the device 2 receives a confirmation signal from the controller 4 that enrollment was successful.

Figure 3:
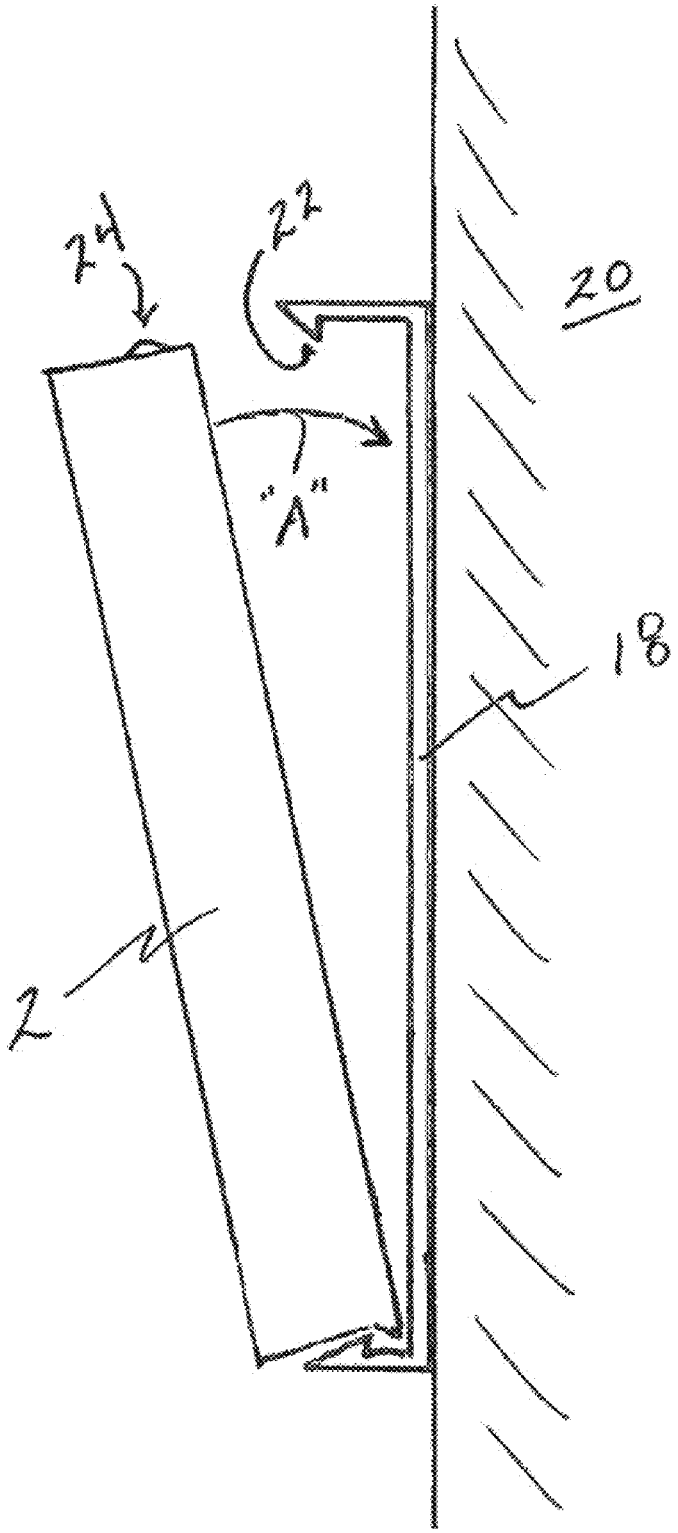
FIG. 3 shows an exemplary arrangement for activating the automatic enrollment feature of a wireless device upon engagement of the device with an associated wall bracket.

FIG. 3 shows an exemplary arrangement for actuating a device's tamper switch upon engagement of the device in an associated wall bracket As illustrated, the two-way wireless device 2 is snapped into engagement with an associated wall bracket 18 that has been pre-attached to a wall 20 or other support structure. The bracket 18 may have a protruding member 22 that is sized and positioned to depress a switch 24 on the device 2 when the device is snapped into engagement with the bracket (such as by pressing in the direction of arrow "A"). In one embodiment, the switch 24 is the device's tamper switch, but another switch could also be used.

For devices that do not utilize such wall brackets (e.g., for door contacts), the device's tamper switch (or other switch activating the enroll command) is automatically depressed when the battery door of the device is closed (again, by providing a protrusion on the door that engages the switch when the door is closed). In either case, the enroll command is sent when the switch is automatically depressed.

Referring again to FIG. 1, in an exemplary embodiment, the system 1 comprises a two-way wireless keypad 3 for mounting near the front entry door of a residence that will be monitored. The system 1 also includes a plurality of two-way wireless devices 2, including door contacts, window contacts, smoke detectors and motion detectors mounted throughout the first and second floors of the residence. The controller 4 and control panel 14 may be mounted locally, or they may be mounted in a remote location such as the basement.

Figure 4:
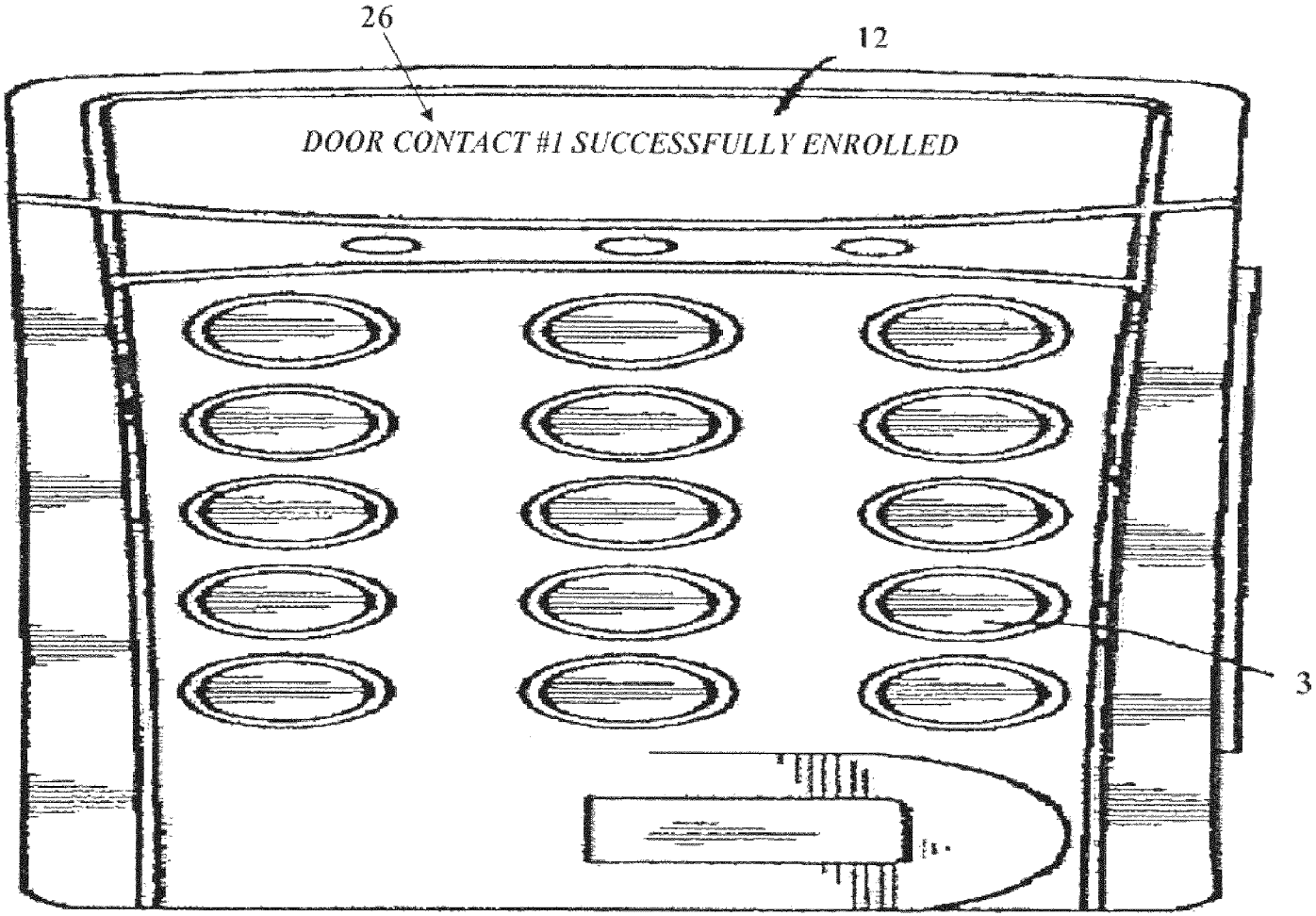
FIG. 4 shows an exemplary embodiment of a wireless keypad for providing visual indication that a two-way wireless device has been successfully enrolled in the system.

With the disclosed system and method, the installer may configure the controller 4 in enroll mode. The first device to be enrolled may be the two-way wireless keypad 3, which may be enrolled by snapping the keypad 3 into its mounting receptacle near the front door. The keypad 3 sends its wireless enroll signal to the controller 4, which assigns it to the first keypad/device slot and sends out a confirmation signal indicating that the keypad has been successfully enrolled. The confirmation signal may be displayed as a textual message displayed on the graphical display 12 of the keypad 3 (see FIG. 4).

Once the wireless keypad is enrolled, the installer can use it as a mobile device to confirm enrollment of each of the remaining two-way wireless devices 2 that will be installed as part of the system 1. To do so, the installer simply removes the enrolled keypad 3 from the wall bracket and carries it to the next device to be enrolled. For example, the installer may next enroll a front door contact 2 by snapping the contact into its mounting bracket (or by closing the battery door, or by manually pressing its tamper switch). The front door contact 2 will then send its enroll signal to the controller 4 which will send back an enroll confirmation signal to the door contact 2 and/or the keypad 3. The installer can view, via the keypad display 12, a textual message (or other confirmation) 26 indicating that the door contact 2 has been successfully enrolled (see FIG. 4). The installer can then proceed to each of the remaining two-way wireless devices in series, again carrying the keypad with him) to enroll, and confirm enrollment of, each of the devices 2 in the system 1 in series. When the last device 2 is enrolled, the installer can carry the keypad 3 back to its mounting receptacle near the front door, snap the keypad 3 back into receptacle, and the enrollment process is complete.

In another embodiment, predetermined zones are set in the controller 4 prior to enrolling the devices 2. This may be useful for large buildings, such as apartment or condominium complexes that have multiple monitored units each having identical devices installed in identical locations. In such an arrangement, the controller 4 may be pre-programmed to expect that the first two devices 2 enrolled will be door contacts (e.g., for a patio door and a main door). As such, these devices may be automatically assigned to the first and second zones. A third zone may be automatically assigned to a motion detector (installed third), and a fourth zone may be assigned to a smoke detector (installed last). Thus arranged, the installer need only snap each device 2 into place, in sequence, and all information is automatically programmed into the controller. This method can reduce the total amount of identifying information sent by each device 2, since the controller already knows which device to expect when a wireless signal is received.

Figure 5:
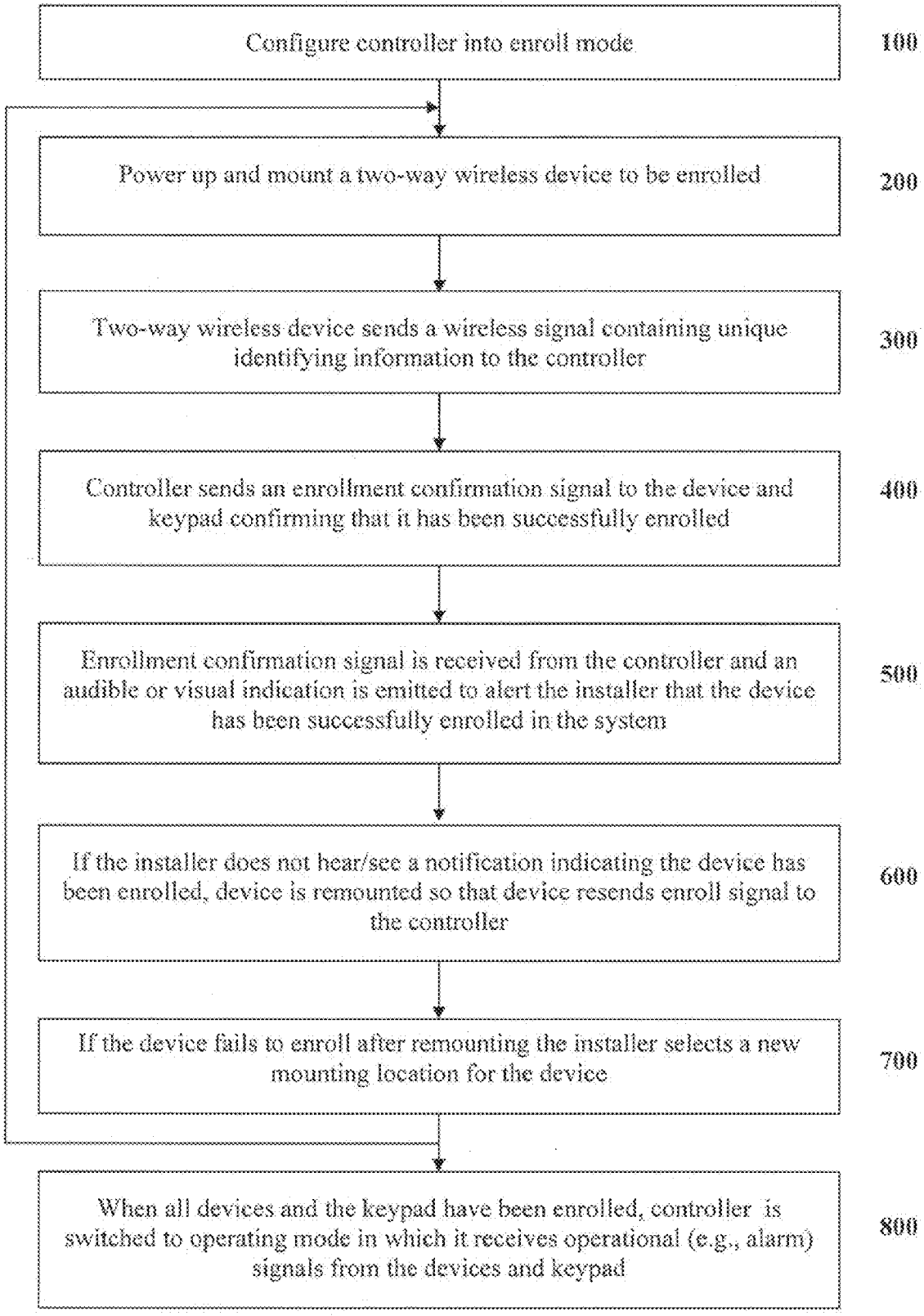
FIG. 5 is a flowchart describing an exemplary method of operating the system of FIG. 1.

Referring now to FIG. 5, in one exemplary embodiment of the disclosed method, an installer (e.g., technician or other user) may place the controller 4 into an enroll mode at step 100. At step 200, the installer may power up and mount a two-way wireless devices 2 to be enrolled. At step 300, the device 2 may send a wireless signal containing unique identifying information to the controller 4. At step 400, the controller 4 sends back an enrollment confirmation signal to the device 2 confirming that it has been successfully enrolled. At step 500 the device 2 and keypad 3 receive the enrollment confirmation signal from the controller 4, and a visual and/or audible indication is provided to alert the installer that the device 2 has been successfully enrolled in the system. Where a visual indication is provided, it may include a message appearing on the keypad display 12. Where an audible indication is provided, it may be a sound emitted by the keypad 3, the device 2 (for devices capable of producing sounds), or a local siren blast. The audible alert can be a series of pulsed sounds that provide the installer with specific information relating to the success of the enrollment. For example, a single pulse may represent low wireless signal strength between the two-way wireless device 2 and the controller 4; two pulses may represent good wireless signal strength, and three pulses may represent excellent wireless signal strength. If, after the device 2 has been snapped into its mounting bracket causing the device to send its enroll command, the installer does not hear/see a notification that the device has been enrolled, the installer may, at step 600, elect to remount the device in its bracket, thus inducing the device to resend its enroll signal to the controller. If the device 2 still fails to enroll, it may indicate that the wireless signal being sent by the device is not being received by the controller 4. In such a case, at step 700 the installer may select a new mounting location for the device 2, and then proceed to re-run the enroll sequence, starting again at step 200. When the device is successfully enrolled, steps 200-700 are repeated in series for each of the remaining two-way wireless devices 2 to be installed in the system.

When all devices 2 and the keypad 3 have been enrolled, the controller 4 is switched into operating mode at step 800. In operating mode, the controller is configured to receive operational (e.g., alarm) signals from the devices 2 and keypad 3.

The wireless signal sent by the two-way wireless devices 2 can contain the serial number, other unique identifier, or any additional useful information relating to the device 2 or the type of device being enrolled. Examples of such information include battery power, wireless signal strength, and the like.

The enroll confirmation signal may instruct the devices to begin and/or resume normal operations (e.g., motion detectors look for motion, smoke detectors start to monitor for smoke).

The device enrollment process can be performed for a plurality of different zones and systems using the aforementioned method.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A method for enrolling two-way wireless devices in a security system, comprising:

receiving, at a controller, a wireless signal from each of a plurality of two-way wireless devices, the wireless signal from each two-way wireless device containing a unique identifier associated with that two-way wireless device;

storing the unique identifiers in memory associated with the controller; and transmitting, from the controller, a wireless signal to each of the plurality of two-way wireless devices, the signal confirming enrollment of the plurality of two-way wireless devices.

2. The method of claim 1, wherein the receiving step comprises receiving, at the controller, wireless signals from each of the plurality of two-way wireless devices in series.

3. The method of claim 1, wherein the receiving step comprises receiving, at the controller, wireless signals from each of the plurality of two-way wireless devices in a predetermined sequence.

4. The method of claim 3, wherein the predetermined sequence corresponds to predetermined zones in the controller.

5. The method of claim 1, wherein each of the plurality of two-way wireless devices automatically transmits the unique identifier associated with that two-way wireless device upon engagement of the device with an associated mounting bracket.

6. The method of claim 1, wherein, in response to the signal confirming enrollment, at least one of the plurality of two-way wireless devices emits an audible or visual alert.

7. The method of claim 6, wherein the audible alert comprises a series of pulsed sounds, the series of pulsed sounds corresponding to a strength of the wireless signal sent by the controller and received by the device that is being enrolled.

8. The method of claim 1, wherein at least one of the plurality of two-way wireless devices comprises a two-way wireless keypad.

9. The method of claim 8, wherein in response to the wireless signal transmitted by the controller, a visual confirmation is displayed on the keypad to confirm that at least one of the two-way wireless devices has been enrolled.

10. The method of claim 8, wherein, in response to the signal confirming enrollment, the keypad emits an audible or visual alert.

11. The method of claim 1, wherein the wireless signal from at least one of the plurality of two-way wireless devices is transmitted via a method selected from the list consisting of radio frequency (RF), infrared (IR) and laser.

12. The method of claim 1, wherein the signal confirming enrollment of the plurality of two-way wireless devices further instructs the associated wireless device to reconfigure from an enroll mode to a normal operation mode.

13. A system for enrolling wireless devices in a security system, comprising a controller having a processor, and a plurality of two-way wireless devices, the controller performing the steps comprising:

receiving, at a controller, a wireless signal from each of a plurality of two-way wireless devices, the wireless signal from each two-way wireless device containing a unique identifier associated with that two-way wireless device;

storing the unique identifiers in memory associated with the controller; and transmitting, from the controller, a wireless signal to each of the plurality of two-way wireless devices, the signal confirming enrollment of the plurality of two-way wireless devices.

14. The system of claim 13, wherein the receiving step comprises receiving, at the controller, wireless signals from each of the plurality of two-way wireless devices in series.

15. The system of claim 13, wherein the receiving step comprises receiving, at the controller, wireless signals from each of the plurality of two-way wireless devices in a predetermined sequence.

16. The system of claim 15, wherein the predetermined sequence corresponds to predetermined zone in the controller.

17. The system of claim 13, wherein each of the plurality of two-way wireless devices automatically transmits the unique identifier associated with that two-way wireless device upon engagement of the device with an associated mounting bracket.

18. The system of claim 13, wherein, in response to the signal confirming enrollment, at least one of the plurality of two-way wireless devices emits an audible or visual alert.

19. The system of claim 18, wherein the audible alert comprises a series of pulsed sounds, the series of pulsed sounds corresponding to a strength of the wireless signal sent by the controller.

20. The system of claim 13, wherein at least one of the plurality of two-way wireless devices comprises a two-way wireless keypad.

21. The system of claim 20, wherein in response to the wireless signal transmitted by the controller, a visual confirmation is displayed on the keypad to confirm that at least one of the two-way wireless devices has been enrolled.

22. The system of claim 21, wherein, in response to the signal confirming enrollment, the keypad emits an audible or visual alert.

23. The system of claim 13, wherein the wireless signal from at least one of the plurality of two-way wireless devices is transmitted via a method selected from the list consisting of radio frequency (RF), infrared (IR), laser and ultrasound.

24. The system of claim 13, wherein the signal confirming enrollment of the plurality of two-way wireless devices further instructs the associated wireless device to reconfigure from an enroll mode to a normal operation mode.

25. A method for enrolling a two-way wireless device in a security system, comprising:

receiving, at a controller, a wireless signal from a two-way wireless device, the wireless signal from the two-way wireless device containing a unique identifier associated with the two-way wireless device;

storing the unique identifier in memory associated with the controller; and transmitting, from the controller, a wireless signal to the two-way wireless device, the signal confirming enrollment of the two-way wireless device in the security system.

* * * * *